United States Patent [19]

Hodes

[11] 4,119,462

[45] Oct. 10, 1978

[54] COLOR PHOTOGRAPHIC DEVELOPER COMPOSITION

[75] Inventor: Harvey A. Hodes, Eatontown, N.J.

[73] Assignee: The United States of America as represented by the Secretary of the Army, Washington, D.C.

[21] Appl. No.: 800,123

[22] Filed: May 24, 1977

[51] Int. Cl.[2] ..... G03C 5/30

[52] U.S. Cl. ..... 96/66.3; 96/66 R

[58] Field of Search ..... 96/66, 66.3, 66.4, 66.5, 96/22

[56] References Cited

U.S. PATENT DOCUMENTS

| | | | |
|---|---|---|---|
| 2,371,740 | 3/1945 | Dearing et al. | 96/59 |
| 2,515,147 | 7/1950 | Wasley | 96/22 |
| 3,520,690 | 7/1970 | Nagae et al. | 96/22 |
| 3,823,017 | 7/1974 | Hodes | 96/66.4 |

OTHER PUBLICATIONS

Mason, Photographic Processing Chemistry, 1966, p. 43.

*Primary Examiner*—Mary F. Kelley

*Attorney, Agent, or Firm*—Nathan Edelberg; Jeremiah Murray; Roy E. Gordon

[57] ABSTRACT

A color photographic developer composition is provided that is capable of accelerating the process of development of multicolor, multilayer color film under actual processing conditions by including in the developer composition about 0.5 to 1.0 percent by volume of the composition of 2-anilinoethanol.

3 Claims, No Drawings

COLOR PHOTOGRAPHIC DEVELOPER COMPOSITION

The invention described herein may be manufactured, used, and licensed by or for the Government for governmental purposes without the payment to me of any royalty thereon.

BACKGROUND OF THE INVENTION

In U.S. Pat. No. 3,823,017 issued July 9, 1974 to Harvey A. Hodes for "Color Photographic Developer Compositions," there is disclosed and claimed the use of 2-anilinoethanol in amounts from about 0.1 to 0.15 percent by volume of the developer composition as an effective anti-oxidant in color developer compositions. The color developer compositions in which 2-anilinoethanol was effective as an anti-oxidant were typically those containing a substituted paraphenylenediamine as the color developing agent. Such substituted paraphenylenediamines include β-methanesulphonamidoethyl ethyl amino toluidine sesquisulphate hydrate which is known in the trade as CD3, N,N' - diethyl paraphenylenediamine hydrochloride, hydroxyethylethylparaphenylenediaminesulphate, and diethylaminoortho-toluidine hydrochloride.

Though 2-anilinoethanol used in the amounts taught in U.S. Pat. No. 3,823,017 is effective as an anti-oxidant in preventing the spontaneous decomposition of the developer under storage conditions, it would still be desirable to accelerate the process of development of multicolor, multilayer, color film under actual processing conditions.

SUMMARY OF THE INVENTION

The general object of this invention is to provide a color photographic developer composition that is capable of speeding up the process of development of multicolor, multilayer color film under actual processing conditions. A particular object of the invention is to provide such a composition that contains a substituted paraphenylenediamine as the color developing agent.

The aforementioned objects have now been attained by adding to the typical color developing compositions about 0.5 to 1.0 percent by volume of the composition of 2-anilinoethanol. For example, the invention may be carried out by adding 5.0 milliliters of 2-anilinoethanol to a typical color developing composition as known in the art and containing the following ingredients:

| TYPICAL COLOR DEVELOPING COMPOSITION | | |
|---|---|---|
| CD3 | grams | 7.5 |
| $Na_2SO_3$ | grams | 2.0 |
| Benzyl Alcohol | milliliters | 5.0 |
| NaOH | grams | 15.0 |
| Borax | grams | 60.0 |
| KBr | grams | 1.5 |
| Water to make 1 liter | | |
| pH is adjusted to 11.5 | | |

DESCRIPTION OF THE PREFERRED EMBODIMENT

The typical color developing composition described in the summary of the invention and not containing 2-anilinoethanol is used to process an exposed conventional multicolor, multilayer color film as for example Kodak Ektacolor Type S containing color forming couplers. After agitating the film at 75 degrees F. for five and one half minutes in the typical color developing composition, the film strip is transferred to a combined bleach-fixing bath that contains the following ingredients:

| COMBINED BLEACH-FIXING BATH | Grams |
|---|---|
| Ammonium thiosulfate | 100 |
| Iron salt of ethylene diamine tetracetic acid | 100 |
| Sodium sulfite | 6.7 |
| Water to make 1 liter | |
| pH is adjusted to 5.8 to 6.0 | |

The film strip is agitated in the above bleach-fixing bath for 3 minutes, then left in running water for about two minutes, then removed and left to dry. The sensitometric results obtained for the processed film are listed in Table I.

TABLE I

| | Fog | Speed Point | Gamma | Dmax |
|---|---|---|---|---|
| Red | 0.20 | 0.87 | 0.61 | 1.8 |
| Green | 0.76 | 0.87 | 0.76 | 2.42 |
| Blue | 0.93 | 0.73 | 0.81 | 2.68 |

To the typical color developing composition described in the summary of the invention, there is then added 10.0 milliliters or an amount of 2-anilinoethanol equivalent to about 1.0 percent by volume of the developing composition. A strip of Kodak Ektacolor Type S color film that has been exposed is developed with this developing composition in exactly the same manner as described for the developing composition without 2-anilinoethanol. The sensitometric results obtained for the film processed with the color developing composition containing 2-anilinoethanol are listed in Table II.

TABLE II

| | Fog | Speed Point | Gamma | Dmax |
|---|---|---|---|---|
| Red | 0.26 | 0.77 | 0.75 | 2.32 |
| Green | 0.82 | 0.74 | 1.0 | 3.02 |
| Blue | 1.0 | 0.64 | 1.14 | 3.48 |

A comparison of the sensitometric results of Table I with those of Table II indicates that Dmax and gamma are increased where 2-anilinoethanol is the typical color developing composition. Speed points are less where 2-anilinoethanol is in the typical color developing composition indicating an increase in development speed. Fog, however, is slightly increased where 2-anilinoethanol is in the typical color developing composition. The average speed point where 2-anilinoethanol is not present is 0.82. Where 2-anilinoethanol is present, the average speed point is 0.72. This amounts to about a 13 percent increase in speed where 2-anilinoethanol is present.

Table III illustrates the sensitometric results of shortening development time from the 5½ minutes as shown in Table I to 4½ minutes. The difference is that the 4½ minutes processing time in Table III is achieved by the addition of one percent by volume of 2-anilinoethanol.

TABLE III

| | Fog | Speed Point | Gamma | Dmax |
|---|---|---|---|---|
| Red | 0.20 | 0.90 | 0.62 | 1.62 |
| Green | 0.78 | 0.86 | 0.86 | 2.76 |
| Blue | 0.96 | 0.82 | 0.93 | 3.1 |

The similarities between the sensitometric results in Tables I and III are readily apparent, and it is obvious that processing time can be cut about a minute, or about 18 percent.

I wish it to be understood that I do not desire to be limited to the exact details described, for obvious modifications will occur to a person skilled in the art.

What is claimed is:

1. In a color photographic developer composition containing a substituted paraphenylenediamine as the color developing agent, the improvement of adding about 0.5 to 1.0 percent by volume of 2-anilinoethanol to the developer composition.

2. An improved color photographic developer composition according to claim 1 in which β-methanesulphonamidoethyl ethyl amino toluidine sesquisulfate hydrate is the color developing agent.

3. An improved color photographic developer composition according to claim 1 consisting of the following ingredients:

| | | |
|---|---|---|
| β -methanesulphonamidoethyl ethyl amino toluidine sesquisulfate hydrate | grams | 7.5 |
| $Na_2SO_3$ | grams | 2.0 |
| Benzyl Alcohol | millimeters | 5.0 |
| NaOH | grams | 15.0 |
| $Na_2B_4O_7 \cdot H_2O$ | grams | 60.0 |
| KBr | grams | 1.5 |
| 2-anilinoethanol | millimeters | 10.0 |
| Water to make 1 liter | | |
| pH is adjusted to 11.5 | | |

* * * * *